US007971953B2

(12) United States Patent
Ishii et al.

(10) Patent No.: US 7,971,953 B2
(45) Date of Patent: Jul. 5, 2011

(54) RECORDING-MEDIUM-RESIDUAL-QUANTITY DETECTING DEVICE, RECORDING APPARATUS, AND LIQUID EJECTING APPARATUS

(75) Inventors: Takayuki Ishii, Shiojiri (JP); Masaki Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 768 days.

(21) Appl. No.: 12/057,723

(22) Filed: Mar. 28, 2008

(65) Prior Publication Data

US 2008/0239052 A1 Oct. 2, 2008

(30) Foreign Application Priority Data

Mar. 30, 2007 (JP) ..... 2007-095635

(51) Int. Cl.
*B41J 29/38* (2006.01)
*B41J 2/01* (2006.01)

(52) U.S. Cl. ..... 347/16; 347/104; 347/105

(58) Field of Classification Search ..... 347/16, 347/104, 105

See application file for complete search history.

(56) References Cited

FOREIGN PATENT DOCUMENTS

| | | | |
|---|---|---|---|
| JP | 05-016499 | * | 1/1993 |
| JP | 2001-287862 | | 10/2001 |
| JP | 2001-294350 | | 10/2001 |
| JP | 2004-018156 | | 1/2004 |

* cited by examiner

*Primary Examiner* — Uyen-Chau N Le
*Assistant Examiner* — Kajli Prince
(74) *Attorney, Agent, or Firm* — Workman Nydegger

(57) ABSTRACT

A recording-medium-residual-quantity detecting device includes a first rotation-quantity detecting unit that detects a rotation quantity of a roll in which a recording medium is wound. A second rotation-quantity detecting unit detects a rotation quantity of a transportation roller that transports the recording medium by rotating in contact with the recording medium that is unwound from the roll. A controlling unit has a winding control mode in which driving units of the device are controlled so that rotational powers to wind the recording medium into the roll without slack between the roll and the transportation roller are applied to the roll and the transportation roller. The residual quantity of the recording medium is calculated on the basis of a rotation quantity θr of the roll and a rotation quantity θs of the transportation roller that are respectively detected by the rotation-quantity detecting units when the winding control mode is executed.

5 Claims, 6 Drawing Sheets

RECORDING-MEDIUM-RESIDUAL-QUANTITY DETECTING DEVICE, RECORDING APPARATUS, AND LIQUID EJECTING APPARATUS

BACKGROUND

1. Technical Field

The present invention relates to recording-medium-residual-quantity detecting devices that detect the residual quantity of a recording medium and are included in recording apparatuses, to which the invention also relates, that perform recording by feeding the recording medium from a roll in which the recording medium is wound. The invention also relates to liquid ejecting apparatuses.

Herein, liquid ejecting apparatuses are not limited to recording apparatuses such as printers, copiers, and facsimiles that include an ink jet recording head and perform recording on a recording medium by ejecting ink from the recording head. Liquid ejecting apparatuses include apparatuses that cause a liquid ejecting head, an equivalent of the ink jet recording head, to eject liquid, a material suitable for the required use instead of ink, toward an ejection target, an equivalent of the recording medium, so that the liquid adheres to the ejection target.

Examples of the liquid ejecting head other than the recording head include colorant ejecting heads used in manufacturing color filters of liquid crystal displays, electrode-material (conductive-paste) ejecting heads used in forming electrodes of organic electroluminescence (EL) displays and surface-emitting displays (field emission displays abbreviated as FEDs), bioorganic-material ejecting heads used in manufacturing biochips, and sample ejecting heads used as precision pipettes.

2. Related Art

In a printer used with roll paper, unless the residual quantity of the roll paper is known accurately, recording may be started despite there being insufficient residual quantity of the roll paper. In such a case, ink or the like may be wasted. Therefore, in a printer used with roll paper, it is critical to accurately know the residual quantity of the roll paper.

In the known art such as that disclosed in JP-A-5-16499, the residual quantity of roll paper is calculated by calculating the diameter of the roll paper from the difference between the number of rotations of a paper transporting roller and the number of rotations of the roll paper, the numbers being detected by corresponding detectors.

However, in the case where the residual quantity of roll paper is calculated while the transportation of the roll paper is initiated by a paper transporting roller, the roll paper is pulled by the paper transporting roller from the roll. In addition to this, transportation loads are applied to the roll paper in both the upstream and downstream portions of a transportation path with respect to the paper transporting roller. These three loads all act in a direction in which the roll paper tends to slip on the paper transporting roller, thereby easily causing slippage of the roll paper on the paper transporting roller. Consequently, the calculated residual quantity of the roll paper may contain an error.

However, if a dedicated detection roller that is caused to rotate by being in contact with the roll paper is provided for prevention of paper slippage, the complexity and the cost of the apparatus unpreferably increases.

SUMMARY

An advantage of some aspects of the invention is to calculate the residual quantity of roll paper in a more accurate manner by preventing slippage between a paper transporting roller and the roll paper.

According to a first aspect of the invention, a recording-medium-residual-quantity detecting device includes a first rotation-quantity detecting unit that detects a rotation quantity of a roll in which a recording medium is wound, a first driving unit that applies a rotational power to the roll, a second rotation-quantity detecting unit that detects a rotation quantity of a transportation roller that transports the recording medium by rotating in contact with the recording medium that is unwound from the roll, a second driving unit that applies a rotational power to the transportation roller, and a controlling unit that controls the first driving unit and the second driving unit. The controlling unit has a winding control mode in which the first driving unit and the second driving unit are controlled so that rotational powers to wind the recording medium into the roll without slack between the roll and the transportation roller are applied to the roll and the transportation roller. The residual quantity of the recording medium is calculated on the basis of a rotation quantity $\theta r$ of the roll and a rotation quantity $\theta s$ of the transportation roller that are respectively detected by the first rotation-quantity detecting unit and the second rotation-quantity detecting unit when the winding control mode is executed.

In the first aspect, the residual quantity of the recording medium is detected while winding of the recording medium is initiated by the roll. Thus, slippage between the transportation roller and the recording medium is prevented, whereby the residual quantity of the recording medium can be more accurately calculated.

More specifically, when the transportation roller transports the recording medium while keeping the recording medium from having slack between the roll and the transportation roller, the following three forces act on the recording medium at the transportation roller, regardless of the direction in which the transportation roller transports the recording medium for a feeding or winding purpose: a tension (tensile force) applied by the roll, a transportation load applied by a portion of the transportation path near the roll with respect to the transportation roller, and a transportation load applied by the opposite portion of the transportation path.

Now, an exemplary case will be considered where the roll and the transportation roller are rotated in a direction in which the recording medium is fed, i.e., a direction opposite to that in which the recording medium is wound (this rotation of the roll and the transportation roller is hereinafter referred to as "normal rotation"). In other words, transportation of the recording medium is initiated by the transportation roller. In this case, the three forces are all acting in the same direction. This increases a friction necessary at the transportation roller in transporting the recording medium, thereby increasing the possibility of slippage between the transportation roller and the recording medium.

In the first aspect, however, the residual quantity is detected while the roll and the transportation roller are rotated in a direction in which the recording medium is wound (this rotation of the roll and the transportation roller is hereinafter referred to as "reverse rotation"). In other words, the residual quantity of the recording medium is detected while winding of the recording medium is initiated by the roll. In this situation, the directions of the two transportation loads applied by the respective portions of the transportation path are opposite to the direction of the tension applied by the roll. Therefore, the friction necessary to be applied between the transportation roller and the recording medium is much smaller than that in the known case where the residual quantity is detected while the roll and the transportation roller undergo normal rotation. Thus, slippage between the transportation roller and the recording medium is prevented, whereby the residual quantity of the recording medium can be more accurately calculated.

In the first aspect of the invention, it is preferable that a length L of the recording medium that remains wound in the roll be calculated from Expression (1) below:

$$L=\pi(Rra^2-Rrb^2)/t \quad (1)$$

when Rra=Rs(θs/θr), where Rra denotes a radius of an outer circumference of the recording medium that remains wound in the roll, Rrb denotes a radius of an inner circumference of the recording medium that remains wound in the roll, t denotes a thickness of the recording medium, Rs denotes a radius of an outer circumference of the transportation roller, and π denotes the circle ratio.

It is also preferable that the recording-medium-residual-quantity detecting device according to the first aspect further include a unit that detects a length W of the recording medium that has been unwound from the roll when the length L of the recording medium that remains wound in the roll is calculated. The sum of the length L and the length W may be taken as the residual quantity of the recording medium.

In this case, the residual quantity of the recording medium is the sum of the length W of the recording medium that has been unwound from the roll and the length L of the recording medium that remains wound in the roll. Thus, the residual quantity of the recording medium can be known more accurately.

According to a second aspect of the invention, a recording apparatus includes a recording-medium feeding unit that feeds a recording medium from a roll in which the recording medium is wound, a recording unit that performs recording on the recording medium fed from the recording-medium feeding unit, and the recording-medium-residual-quantity detecting device according to the first aspect. With the recording medium according to the second aspect, the same advantage as that in the first aspect can be produced.

According to a third aspect of the invention, a liquid ejecting apparatus includes an ejection-target feeding unit that feeds an ejection target from a roll in which the ejection target is wound, a liquid ejecting unit that performs liquid ejection toward the ejection target fed from the ejection-target feeding unit, and an ejection-target-residual-quantity detecting device that detects a residual quantity of the ejection target. The device includes a first rotation-quantity detecting unit that detects a rotation quantity of the roll, a first driving unit that applies a rotational power to the roll, a second rotation-quantity detecting unit that detects a rotation quantity of a transportation roller that transports the ejection target by rotating in contact with the ejection target that is unwound from the roll, a second driving unit that applies a rotational power to the transportation roller, and a controlling unit that controls the first driving unit and the second driving unit. The controlling unit has a winding control mode in which the first driving unit and the second driving unit are controlled so that rotational powers to wind the ejection target into the roll without slack between the roll and the transportation roller are applied to the roll and the transportation roller. The residual quantity of the ejection target is calculated on the basis of a rotation quantity θr of the roll and a rotation quantity θs of the transportation roller that are respectively detected by the first rotation-quantity detecting unit and the second rotation-quantity detecting unit when the winding control mode is executed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
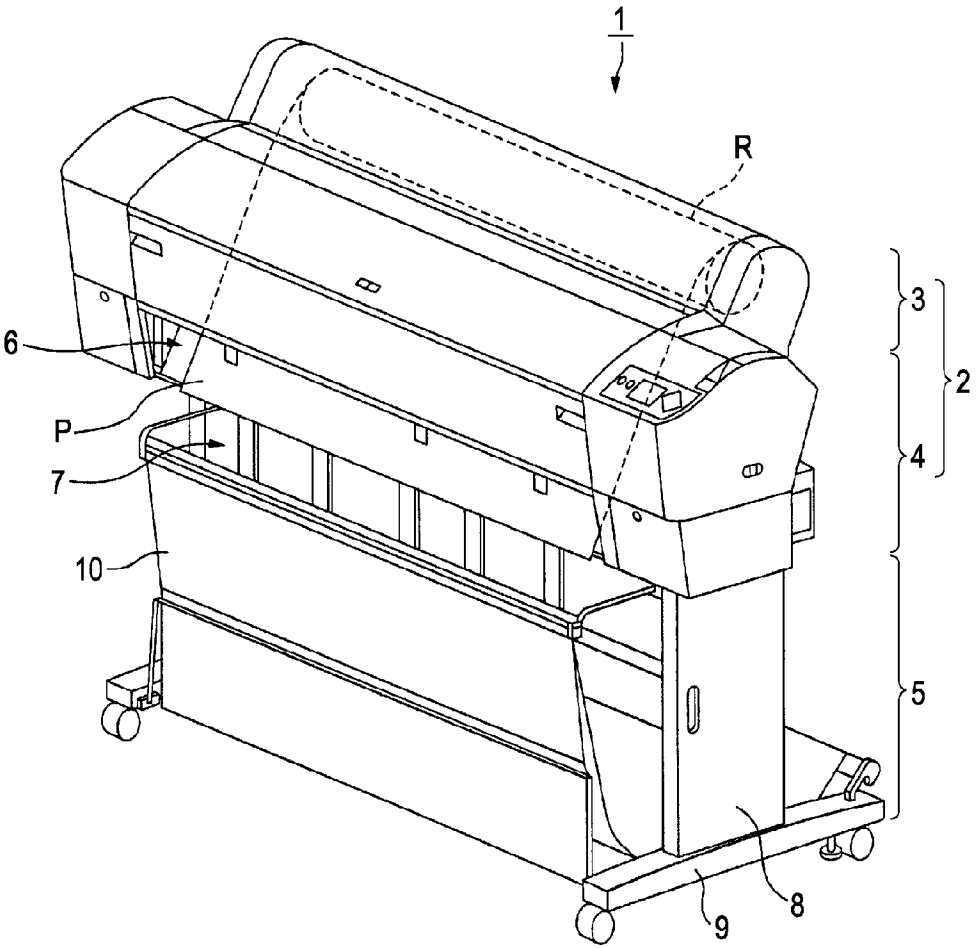
FIG. 1 is an external perspective view of a printer according to an embodiment of the invention.
Figure 2:
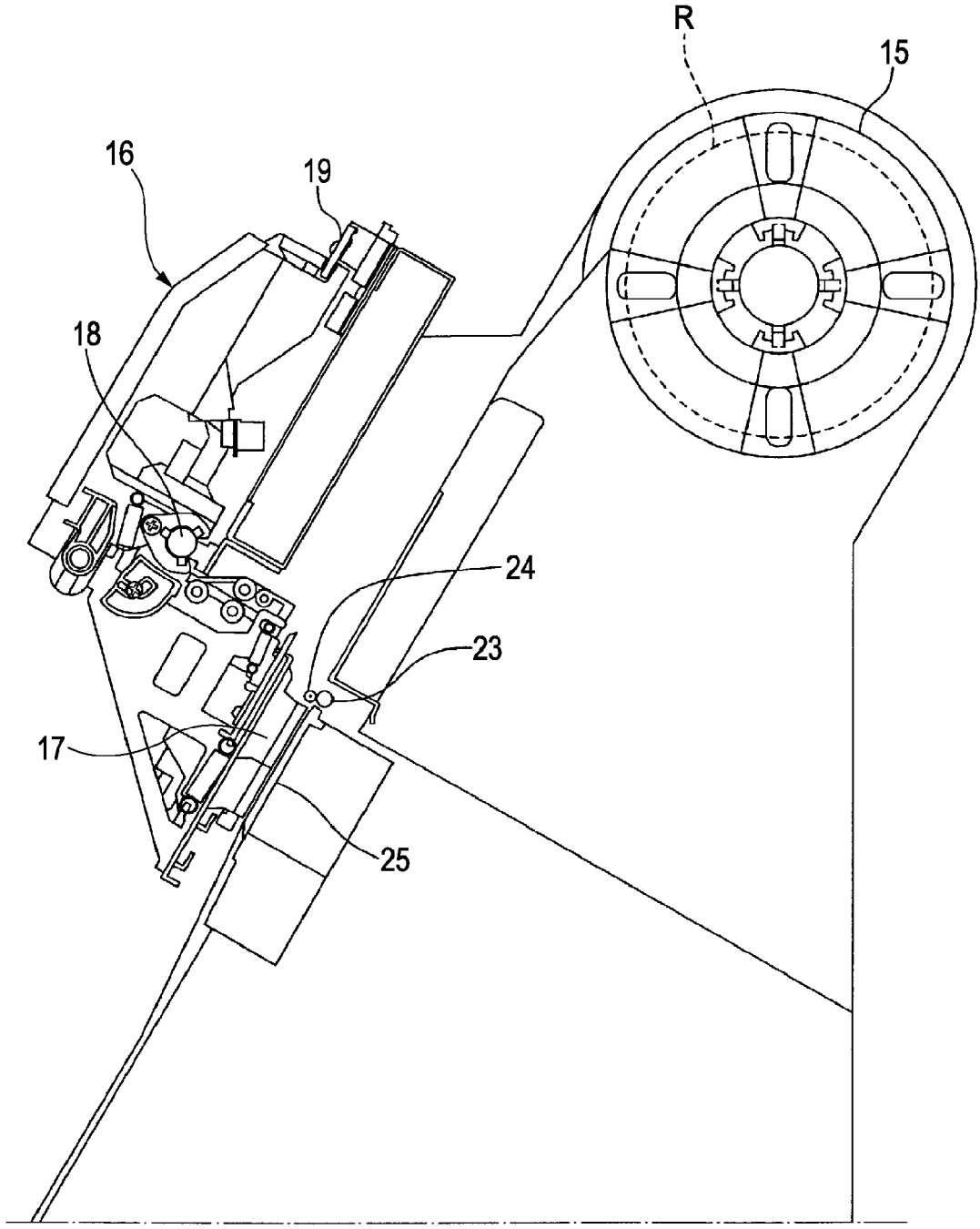
FIG. 2 is a side view of a relevant part of the printer according to the embodiment of the invention.
Figure 3:
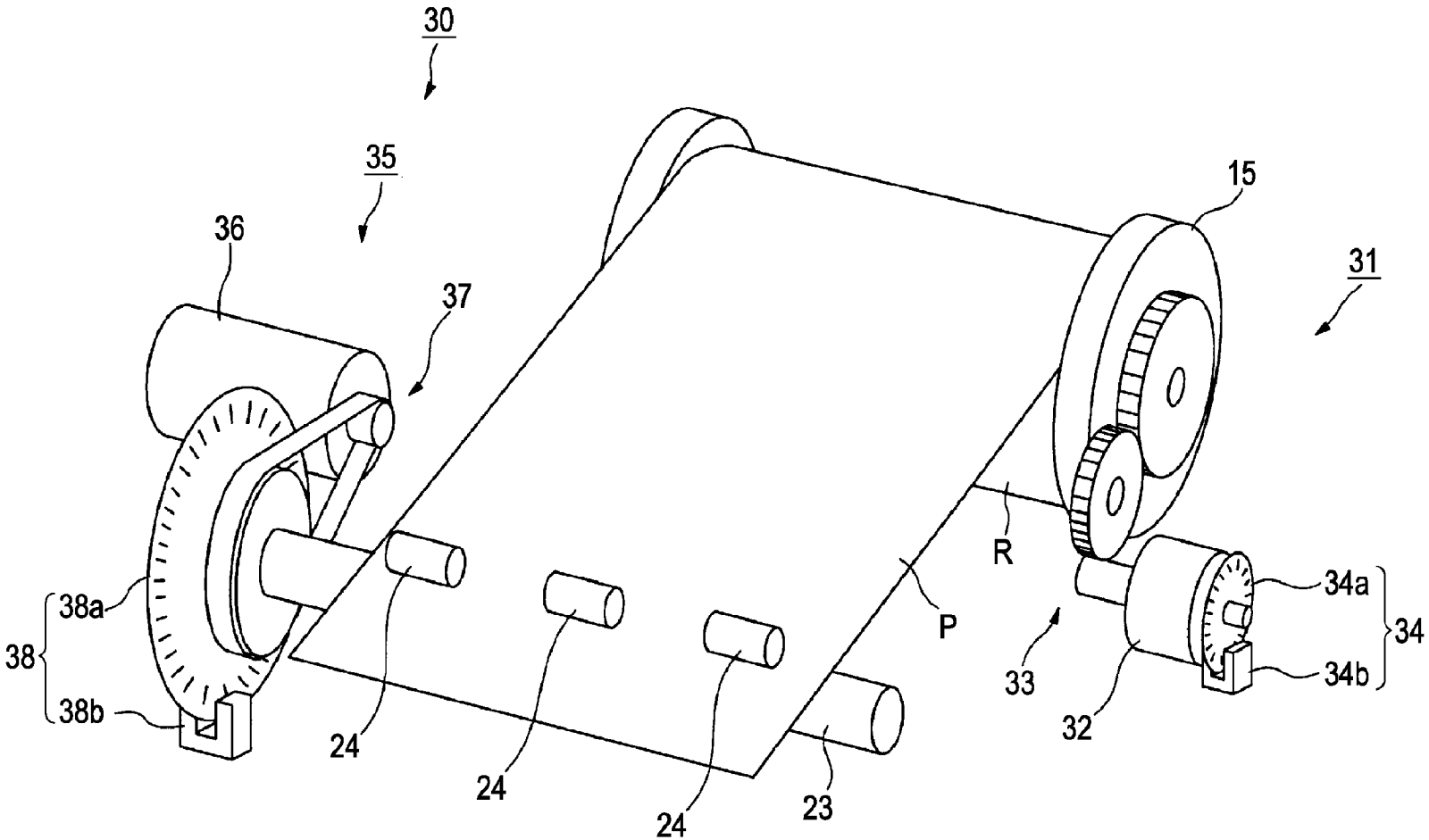
FIG. 3 schematically shows the entire configuration of a detecting device according to the embodiment of the invention.
Figure 4:
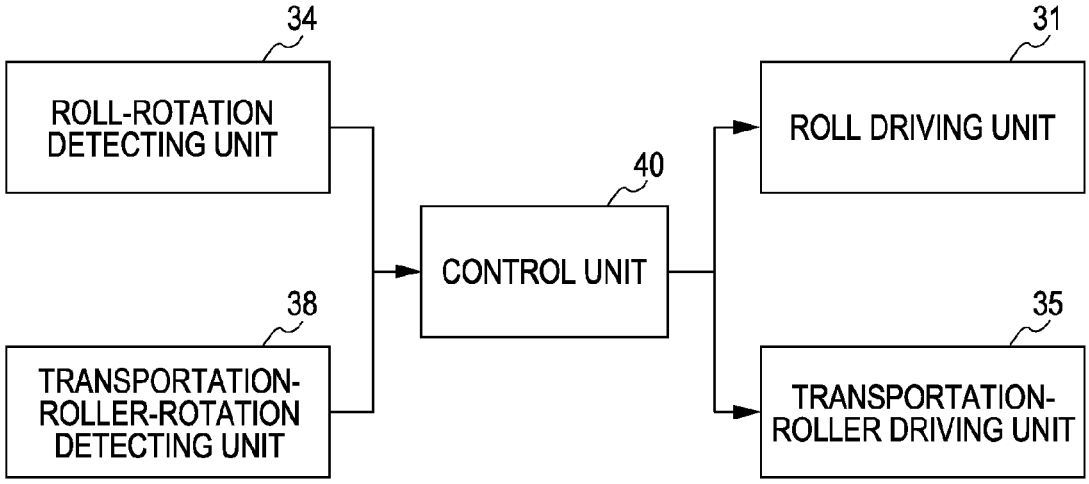
FIG. 4 is a block diagram of a control system controlled by a control unit of the printer according to the embodiment of the invention.
Figure 5:
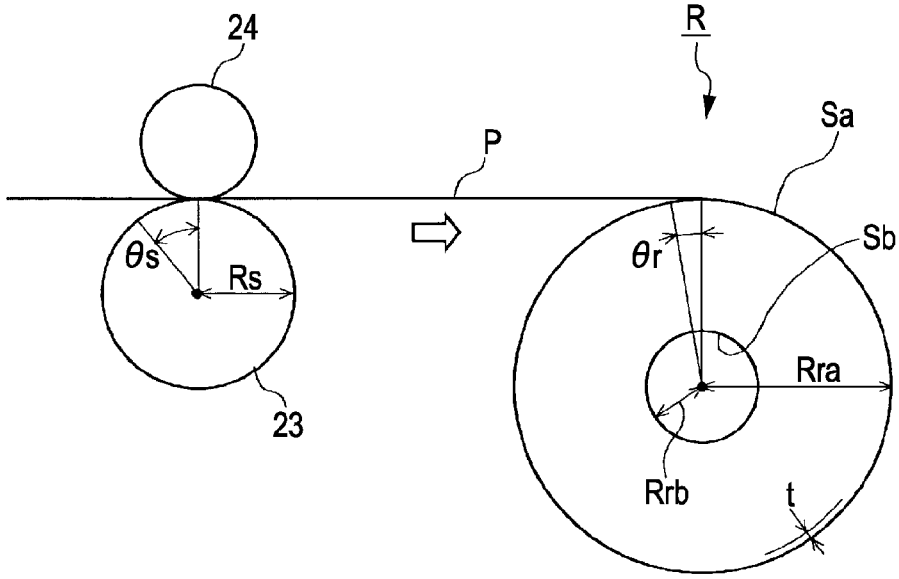
FIG. 5 shows parameters required in calculating the residual quantity of roll paper, including the roll radius and the transportation roller radius.
Figure 6A:
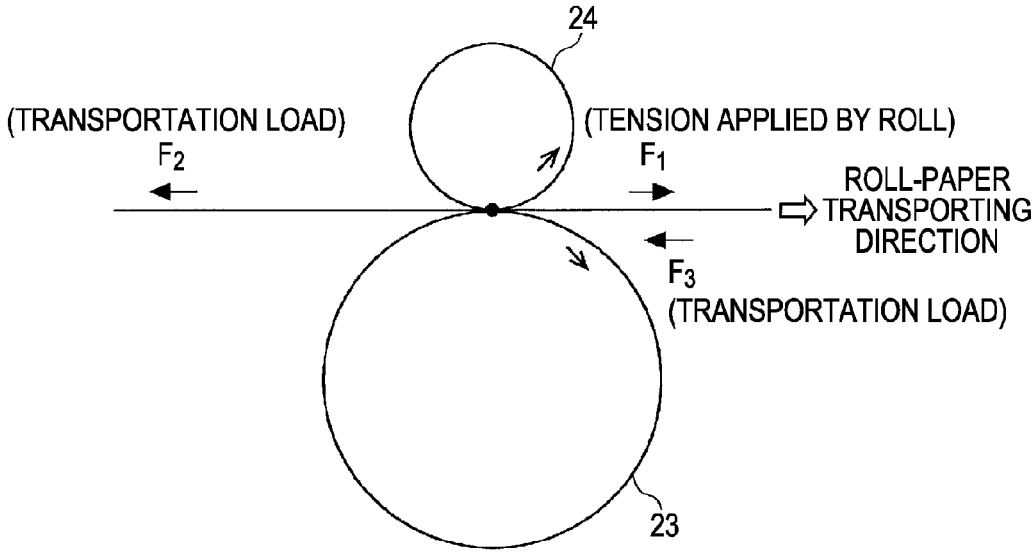
FIG. 6A shows the manner in which tensions are applied to the roll paper when a roll undergoes normal rotation.
Figure 6B:
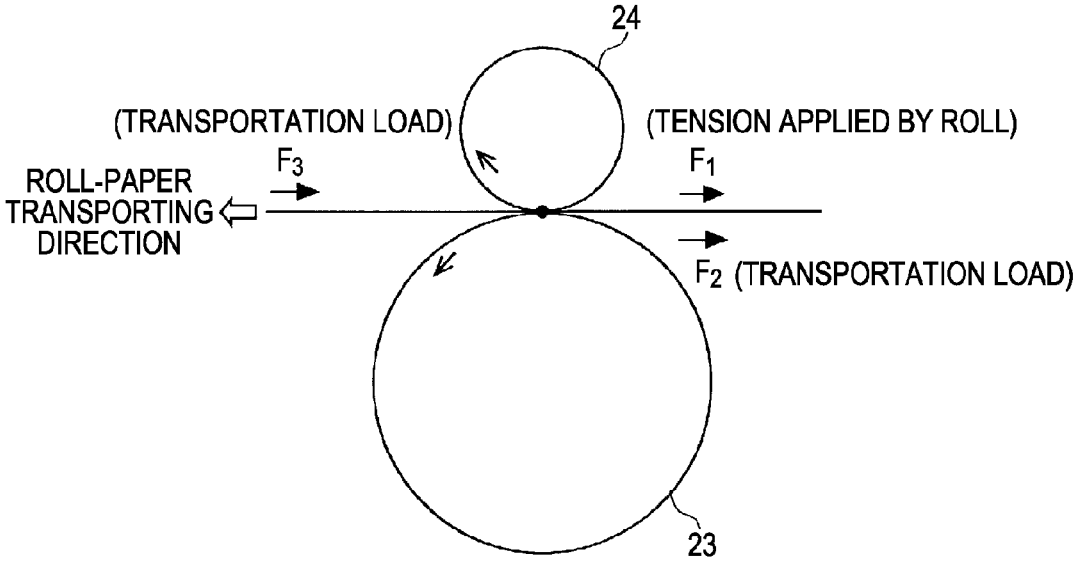
FIG. 6B shows the manner in which tensions are applied to the roll paper when the roll undergoes reverse rotation.

An embodiment of the invention will now be described with reference to FIGS. 1 to 6B. FIG. 1 is an external perspective view of an ink jet printer (hereinafter referred to as a "printer") 1 as an exemplary "recording apparatus" or a "liquid ejecting apparatus" according to the embodiment of the invention. FIG. 2 is a side view of a relevant part of the same. FIG. 3 schematically shows the entire configuration of a detecting device 30 as a "recording-medium-residual-quantity detecting device" according to the embodiment of the invention. FIG. 4 is a block diagram of a control system controlled by a control unit of the printer 1. FIG. 5 shows parameters required in calculating the residual quantity of roll paper, including the roll radius and the transportation roller radius. FIGS. 6A and 6B show the manners in which tensions are applied to the roll paper. FIG. 6A shows the case where the roll undergoes normal rotation. FIG. 6B shows the case where the roll undergoes reverse rotation.

The configuration of the printer 1 will be outlined with reference to FIGS. 1 and 2. The printer 1 is a large printer capable of performing recording on roll paper P as an ejection target or a recording medium with a relatively large width, for example, as large as the A0 or B0 size according to the Japanese Industrial Standards (JIS). The printer 1 includes a main body 2 constituted by a roll-paper feeding unit 3 and a recording execution unit 4, and an ejected-paper receiving unit 5.

The main body 2 is disposed atop of a support 8 standing upright on a base 9, and includes an ejection port 6 through which the roll paper P after being subjected to recording is ejected downward at an angle. A stacker 10 has an opening 7 positioned below the ejection port 6. The roll paper P after recording is ejected through the ejection port 6 toward the opening 7 and then received by the stacker 10.

The roll-paper feeding unit 3 can house a roll-paper roll (hereinafter referred to as a "roll") R. The roll paper P is fed downward at an angle from the roll R toward the recording execution unit 4 that executes recording. Referring to FIG. 2, a roll paper holder 15 is constituted by a spindle (not shown) extending through a hollow core of the roll R, and collars (disk-like members, one of which is shown in FIG. 2) provided at both ends of the spindle. The roll R is fitted with the roll paper holder 15. The roll paper holder 15 is driven by a roll driving mechanism (not shown, to be described below) to rotate, whereby the roll paper P is fed downstream.

The recording execution unit 4 includes a recording head 17 as a liquid ejecting unit or a recording unit that ejects ink as liquid toward the roll paper P, a platen 25 disposed to face the recording head 17, a driving transportation roller 23 as a transportation roller that is provided on the upstream side with respect to the recording head 17 for transporting the roll paper P downstream, driven transportation rollers 24 that are pressed into contact with and rotate following the driving transportation roller 23, and the detecting device 30 to be described below and not shown in FIGS. 1 and 2.

The recording head 17 is mounted on the carriage 16. The carriage 16, which is driven by a motor (not shown) moves with the recording head 17 in a direction in which scanning is performed (the main scanning direction, i.e., the depth direction in FIG. 2) while being guided by the guiding shaft 18 and the guiding plate 19 both extending in the main scanning direction.

On the downstream side with respect to the recording head 17, a paper suction unit (not shown) is provided. With this paper suction unit, the roll paper P is made to be still and is prevented from floating at the downstream side with respect to the recording head 17. Consequently, the degradation of recording quality due to floating of the roll paper P can be prevented.

The outline of the printer 1 is as described above. Now, referring to FIGS. 3 to 6B, the detecting device 30 will be described in detail.

Referring to FIG. 3, the detecting device 30 includes a roll-rotation detecting unit 34 as a first rotation-quantity detecting unit that detects the rotation quantity of the roll R in which the roll paper P is wound, and a roll driving unit 31 as a first driving unit that applies rotational power to the roll R. The detecting device 30 further includes a transportation-roller-rotation detecting unit 38 as a second rotation-quantity detecting unit that detects the rotation quantity of the driving transportation roller 23 that transports the roll paper P by rotating in contact with the roll paper P that is unwound from the roll R, a transportation-roller driving unit 35 as a second driving unit that applies rotational power to the driving transportation roller 23, and a control unit 40 (see FIG. 4) as a controlling unit that controls the roll driving unit 31 and the transportation-roller driving unit 35.

The roll driving unit 31 includes a motor 32 and a power transmission mechanism 33 that transmits the power of the motor 32 to the roll R. When the motor 32 rotates, the roll R is caused to undergo normal rotation (rotation for unwinding the roll paper P) or reverse rotation (rotation for winding the roll paper P). Alternatively, a planet gear mechanism (not shown) may be provided to the power transmission mechanism 33 so as to only transmit the reverse rotational power of the motor 32 to the roll R.

The roll-rotation detecting unit 34 includes a discal scale 34*a* having in its peripheral region a number of light transmitting portions (not shown) and being attached to a rotating shaft of the motor 32, and a detector 34*b* constituted by a light emitter that emits light toward the light transmitting portions and a light receiver that receives the light transmitted through the light transmitting portions.

When the discal scale 34*a* rotates in response to the rotation of the motor 32, the detector 34*b* outputs an active high signal or an active low signal generated in accordance with the light transmitted through the light transmitting portions. The control unit 40 receives the signal that is output from the detector 34*b*, thereby calculating parameters of the roll R, such as the rotation quantity (rotation angle) and rotational speed per unit time.

The transportation-roller driving unit 35 includes a motor 36 and a power transmission mechanism 37 that transmits the power of the motor 36 to the driving transportation roller 23. When the motor 36 rotates, the driving transportation roller 23 is caused to undergo normal rotation (rotation for feeding the roll paper P that has been unwound from the roll R) or reverse rotation (rotation for transporting the roll paper P to be wound in the roll R).

The transportation-roller-rotation detecting unit 38 includes a discal scale 38*a* having in its peripheral region a number of light transmitting portions (not shown) and attached to one end of the driving transportation roller 23, and a detector 38*b* constituted by a light emitter that emits light toward the light transmitting portions and a light receiver that receives the light transmitted through the light transmitting portions.

When the discal scale 38*a* rotates in response to the rotation of the driving transportation roller 23, the detector 38*b* outputs an active high signal or an active low signal generated in accordance with the light transmitted through the light transmitting portions. The control unit 40 receives the signal that is output from the detector 38*b*, thereby calculating parameters of the driving transportation roller 23, such as the rotation quantity (rotation angle) and rotational speed per unit time.

Further, referring to FIG. 4, the control unit 40 receives the signals from the roll-rotation detecting unit 34 and the transportation-roller-rotation detecting unit 38. In accordance with the signals, the control unit 40 controls the roll driving unit 31 (the motor 32) and the transportation-roller driving unit 35 (the motor 36).

The control unit 40 has a winding control mode in which the roll driving unit 31 and the transportation-roller driving unit 35 are controlled so that rotational powers to wind the roll paper P into the roll R without slack between the roll R and the driving transportation roller 23 are applied to the roll R and the driving transportation roller 23. This control mode is executed to calculate the residual quantity of the roll paper P.

More specifically, in this control mode, a rotational power to transport the roll paper P in the winding direction at a transporting speed of $V_1$ is applied to the driving transportation roller 23, while a rotational power to wind the roll paper P into the roll R at a speed $V_2$ faster than the transporting speed $V_1$ is applied to the roll R.

The speed $V_2$ at which the roll paper P is wound into the roll R is a winding speed when the driving transportation roller 23 is ignored. Practically, since the force for transporting the roll paper P applied by the driving transportation roller 23 (the friction between the driving transportation roller 23 and the roll paper P) is set to a large value, the speed for winding the roll paper P (the length of the roll paper P that is wound per unit time) is determined by the rotational speed of the driving transportation roller 23. Accordingly, the speed at which the roll paper P is wound becomes equal to the speed $V_1$.

Further details will be described with reference to FIGS. 5 to 6B. FIG. 5 shows the following parameters: a radius Rra of an outer circumference Sa of the roll paper P wound in the roll R, a radius Rrb of an inner circumference Sb of the roll paper P wound in the roll R, a thickness t of the roll paper P, a radius Rs of the outer circumference of the driving transportation roller 23, a rotation angle θs of the driving transportation roller 23, and a rotation angle θr of the roll R when the driving transportation roller 23 rotates by the rotation angle θs.

The quantity of the roll paper P that has been transported by the driving transportation roller 23 is expressed as Rs×θs. The quantity of the roll paper P that remains wound in the roll R (or the quantity of the roll paper P that has been unwound from the roll R) is expressed as Rra×θr. Since the two quantities are equal to each other, the radius Rra of the roll R is expressed as Rra=RS×(θs/θr).

In FIG. 5, the area of the roll paper P that remains wound in the roll R is expressed as $\pi\times(Rra^2-Rrb^2)$, where π denotes the circle ratio. Hence, a length L of the roll paper P that remains wound in the roll R is expressed as follows:

$$L=\pi\times(Rra^2-Rrb^2)/t \quad (1)$$

Thus, on the basis of the rotation angle θs of the driving transportation roller 23 and the rotation angle θr of the roll R, the length L of the roll paper P that remains wound in the roll R can be calculated.

If the roll paper P has been unwound from the roll R by a certain length W at the detection of the rotation angle θs of the driving transportation roller 23 and the rotation angle θr of the roll R (i.e., at the calculation of the length L of the roll paper P that remains wound in the roll R), the control unit 40 may take the sum of the length L and the length W as the total residual quantity of the roll paper P.

To detect the length W, a unit including the following may be provided, for example: a detector (such as a sensor) that detects the passage of the roll paper P provided in the roll-paper transportation path, and a storage unit that stores data on a length Z of a portion of the transportation path between the detector and the roll R. After the detector that detects the passage of the roll paper P detects the passage of the leading end of the roll paper P, the position of the leading end of the roll paper P in the transportation path can be identified in combination with the detection performed by the transportation-roller-rotation detecting unit 38. That is, on the basis of the position of the leading end and the length Z, the length W of the roll paper P that has been unwound from the roll R at the detection of the rotation angles θs and θr can be calculated.

Next, advantages of the detecting device 30 will be described. The detection of the residual quantity of the roll paper P by the detecting device 30 is performed while winding of the roll paper P is initiated by the roll R, as described above. In this manner, slippage between the driving transportation roller 23 and the roll paper P is prevented, whereby the residual quantity of the roll paper P can be more accurately calculated.

When the driving transportation roller 23 transports the roll paper P while keeping the roll paper P from having slack between the roll R and the driving transportation roller 23, the following three forces act on the roll paper P at the driving transportation roller 23, regardless of the direction in which the driving transportation roller 23 transports the roll paper P for a feeding or winding purpose: a tension (tensile force) applied by the roll R, a transportation load applied by a portion of the transportation path near the roll R with respect to the driving transportation roller 23, and a transportation load applied by the opposite portion of the transportation path.

For example, in the case shown in FIG. 6B where the residual quantity is detected while the roll R and the driving transportation roller 23 undergo normal rotation, the roll paper P is subjected to a tension (tensile force) $F_1$ applied by the roll R, a transportation load $F_2$ applied by a portion (the right half in FIG. 6B) of the transportation path near the roll R with respect to the driving transportation roller 23, and a transportation load $F_3$ applied by the opposite portion (the left half in FIG. 6B) of the transportation path.

The tension $F_1$ and the transportation loads $F_2$ and $F_3$ are all acting in the same direction, as shown in FIG. 6B. This increases a friction necessary at the driving transportation roller 23 in transporting the roll paper P, thereby increasing the possibility of slippage between the driving transportation roller 23 and the roll paper P.

In the embodiment of the invention shown in FIG. 6A, however, the residual quantity is detected while the roll R and the driving transportation roller 23 undergo reverse rotation. That is, the direction of the tension $F_1$ applied by the roll R is opposite to the directions of a transportation load $F_3$ applied by a portion (the right half in FIG. 6A) of the transportation path near the roll R with respect to the driving transportation roller 23 and a transportation load $F_2$ applied by the opposite portion (the left half in FIG. 6A) of the transportation path.

Therefore, the friction necessary to be applied between the driving transportation roller 23 and the roll paper P is much smaller than that in the known case shown in FIG. 6B where the residual quantity is detected while the driving transportation roller 23 undergo normal rotation. Thus, slippage between the driving transportation roller 23 and the roll paper P is prevented, whereby the residual quantity of the roll paper P can be more accurately calculated.

A disadvantage in the case shown in FIG. 6B where the roll R and the driving transportation roller 23 undergo normal rotation is as follows: To suppress slippage between the driving transportation roller 23 and the roll paper P as much as possible, the tension $F_1$ applied by the roll R can be set to a very small value, for example. However, such a method for controlling the roll R is less acceptable and difficult. Moreover, in such a control method, operation may be easily influenced by degradation of the surface condition of the driving transportation roller 23 and the surface condition (slipperiness) of the roll paper P.

In the embodiment of the invention, however, the friction necessary to be applied between the driving transportation roller 23 and the roll paper P is much smaller than that in the known case where the roll R and the driving transportation roller 23 undergo normal rotation. Thus, slippage between the driving transportation roller 23 and the roll paper P is assuredly prevented, whereby the residual quantity of the roll paper P can be more accurately calculated.

What is claimed is:

1. A recording-medium-residual-quantity detecting device comprising:

a first rotation-quantity detecting unit that detects a rotation quantity of a roll in which a recording medium is wound;

a first driving unit that applies a rotational power to the roll;

a second rotation-quantity detecting unit that detects a rotation quantity of a transportation roller that transports the recording medium by rotating in contact with the recording medium that is unwound from the roll;

a second driving unit that applies a rotational power to the transportation roller; and a controlling unit that controls the first driving unit and the second driving unit, wherein the controlling unit has a winding control mode in which the first driving unit and the second driving unit are controlled so that rotational powers to wind the recording medium into the roll without slack between the roll and the transportation roller are applied to the roll and the transportation roller, and wherein a residual quantity of the recording medium is calculated on the basis of a rotation quantity θr of the roll and a rotation quantity θs of the transportation roller that are respectively detected by the first rotation-quantity detecting unit and the second rotation-quantity detecting unit when the winding control mode is executed.

2. The recording-medium-residual-quantity detecting device according to claim 1, wherein a length L of the recording medium that remains wound in the roll is calculated from Expression (1) below:

$$L=\pi(Rra^2-Rrb^2)/t \quad (1)$$

when Rra=Rs(θs/θr), where Rra denotes a radius of an outer circumference of the recording medium that remains wound in the roll, Rrb denotes a radius of an inner circumference of the recording medium that remains wound in the roll, t denotes a thickness of the recording medium, Rs denotes a radius of an outer circumference of the transportation roller, and π denotes the circle ratio.

3. The recording-medium-residual-quantity detecting device according to claim 1, further comprising:

a unit that detects a length W of the recording medium that has been unwound from the roll when the length L of the recording medium that remains wound in the roll is calculated, wherein a sum of the length L and the length W is taken as the residual quantity of the recording medium.

4. A recording apparatus comprising:

a recording-medium feeding unit that feeds a recording medium from a roll in which the recording medium is wound;

a recording unit that performs recording on the recording medium fed from the recording-medium feeding unit; and the recording-medium-residual-quantity detecting device according to claim 1.

5. A liquid ejecting apparatus comprising:

an ejection-target feeding unit that feeds an ejection target from a roll in which the ejection target is wound;

a liquid ejecting unit that performs liquid ejection toward the ejection target fed from the ejection-target feeding unit; and an ejection-target-residual-quantity detecting device that detects a residual quantity of the ejection target, the device including a first rotation-quantity detecting unit that detects a rotation quantity of the roll;

a first driving unit that applies a rotational power to the roll;

a second rotation-quantity detecting unit that detects a rotation quantity of a transportation roller that transports the ejection target by rotating in contact with the ejection target that is unwound from the roll;

a second driving unit that applies a rotational power to the transportation roller; and a controlling unit that controls the first driving unit and the second driving unit, wherein the controlling unit has a winding control mode in which the first driving unit and the second driving unit are controlled so that rotational powers to wind the ejection target into the roll without slack between the roll and the transportation roller are applied to the roll and the transportation roller, and a residual quantity of the ejection target is calculated on the basis of a rotation quantity θr of the roll and a rotation quantity θs of the transportation roller that are respectively detected by the first rotation-quantity detecting unit and the second rotation-quantity detecting unit when the winding control mode is executed.

* * * * *